US005586829A

United States Patent [19]

Schwartz

[11] Patent Number: 5,586,829

[45] Date of Patent: Dec. 24, 1996

[54] SINGLE FOOTPRINT SAME FACE TRI-POCKET ARRAY

[75] Inventor: David C. Schwartz, Southboro, Mass.

[73] Assignee: Productive Environments, Inc., Framingham, Mass.

[21] Appl. No.: 197,500

[22] Filed: Feb. 16, 1994

[51] Int. Cl.[6] ..... B42F 21/02; B42F 7/02

[52] U.S. Cl. ..... 402/79; 281/31; 281/38; 402/80 R

[58] Field of Search ..... 402/79, 80 P, 80 R; 281/38, 31; D19/33; 40/159, 537, 405

[56] References Cited

U.S. PATENT DOCUMENTS 4,519,629 5/1985 Podosek ..... 281/31 X 4,795,287 1/1989 Friedman ..... 402/79

4,852,740 8/1989 Sellar et al. ..... 402/79 X

FOREIGN PATENT DOCUMENTS 3447461 1/1986 Germany ..... 402/80 R

*Primary Examiner*—Frances Han

[57] ABSTRACT

This invention relates to inside out folded dual pocket folders, and particularly to the construction of a multi-pocket enclosure which provides three pockets where the entry lips of each successive pocket are stacked one on top of and below the next, all showing on the same face.

13 Claims, 5 Drawing Sheets

SINGLE FOOTPRINT SAME FACE TRI-POCKET ARRAY

BACKGROUND OF THE INVENTION

This invention relates to inside out folded dual pocket folders, and particularly to the construction of a multi-pocket folio enclosure which provides three pockets where the entry lips of each successive pocket are stacked one on top of and below the next, all showing on the same face and being formed in a single footprint section.

Two sided pockets have been available which are formed from a dual pocket folio style pocket folded insideout. These pockets are two entry lips, one on either side of the folded construction and have two open sides. They are unable to support the need for "tri-level front view separate stacking", a requirement for a variety of record keeping applications where information is gathered within a category.

Tri-level stacking on a single face for the purposes of sorting by "Input/Process/Output" or for sorting one the basis of subcategory, as in the separation of a school homework pocket for "homework due/homework returned but in review/homework completed for current reference" have simply been unavailable to date. Tri-level stacking pockets where the pocket array is formed from panels, which panels are formed along two adjacent edges on a back panel which has a single footprint have been unavailable. Tri-level stacking pockets where the pockets are on the front face and where the pocket array is formed from a single panel sectioned and continuously folded piece of materials, where the pocket array can be formed by two folds and a sealing operation, have been available.

SUMMARY OF THE INVENTION

The invention therefore relates to pockets, and in particular to the stacking of an array of three pockets all of which are accessible on the same face side, where the pocket entry lips are layered so as to permit the separation of each of the pockets one from the other.

The invention further relates to the construction of a pocket set of the above described kind, where at least two of the sides of each pocket are enclosed.

Further the invention relates to the construction of a pocket set of the above described kind where three of the sides of each pocket are enclosed, and to the construction of a pocket set having means for attaching the pocket set to a host binding, by way of a hole pattern on one edge thereof.

In particular, the invention relates to the construction of a pocket set according to the invention, formed from one sheet of flexible material such as card stock, where the cut and fold pattern of the card stock allows for the formation of the complete pocket array by a sequence of two folds and a sealing step.

The invention relates to the construction of pockets of this kind from any flexible material such as spun olefin(tyvek™ Dupont), polypropelene, vinyl, paper, plastic of other varieties or like and similar substances having from flexible to subtly rigid properties and being bondable by way of adhesive tabs, electrical bonding, heat sealing, specialty gluing, stapling and the like.

DETAILED DESCRIPTION OF THE INVENTION

Figure 1:
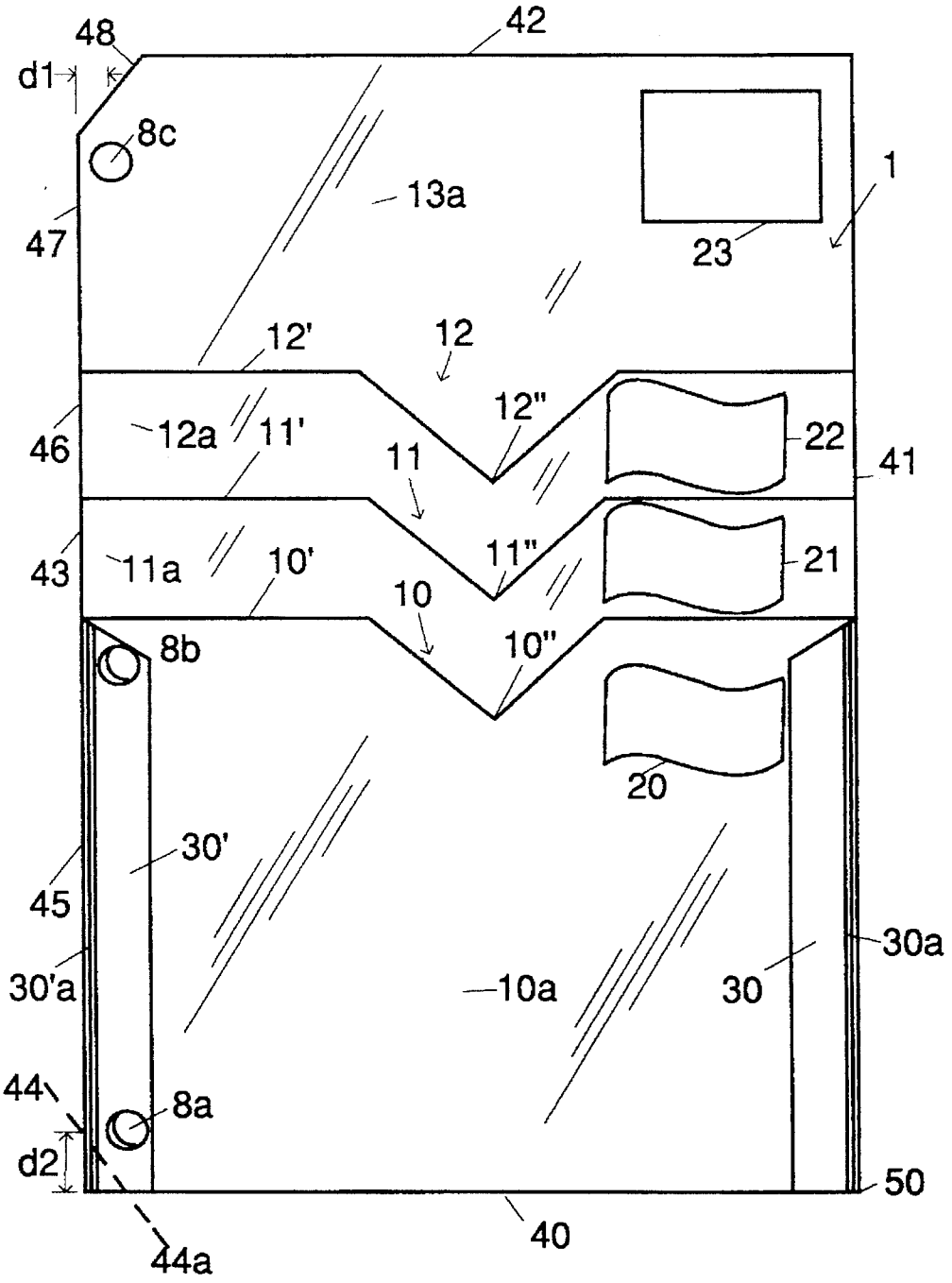
FIG. 1 shows the front view of a tri level pocket with three sub-category lable areas and a larger category label.
Figure 1A:
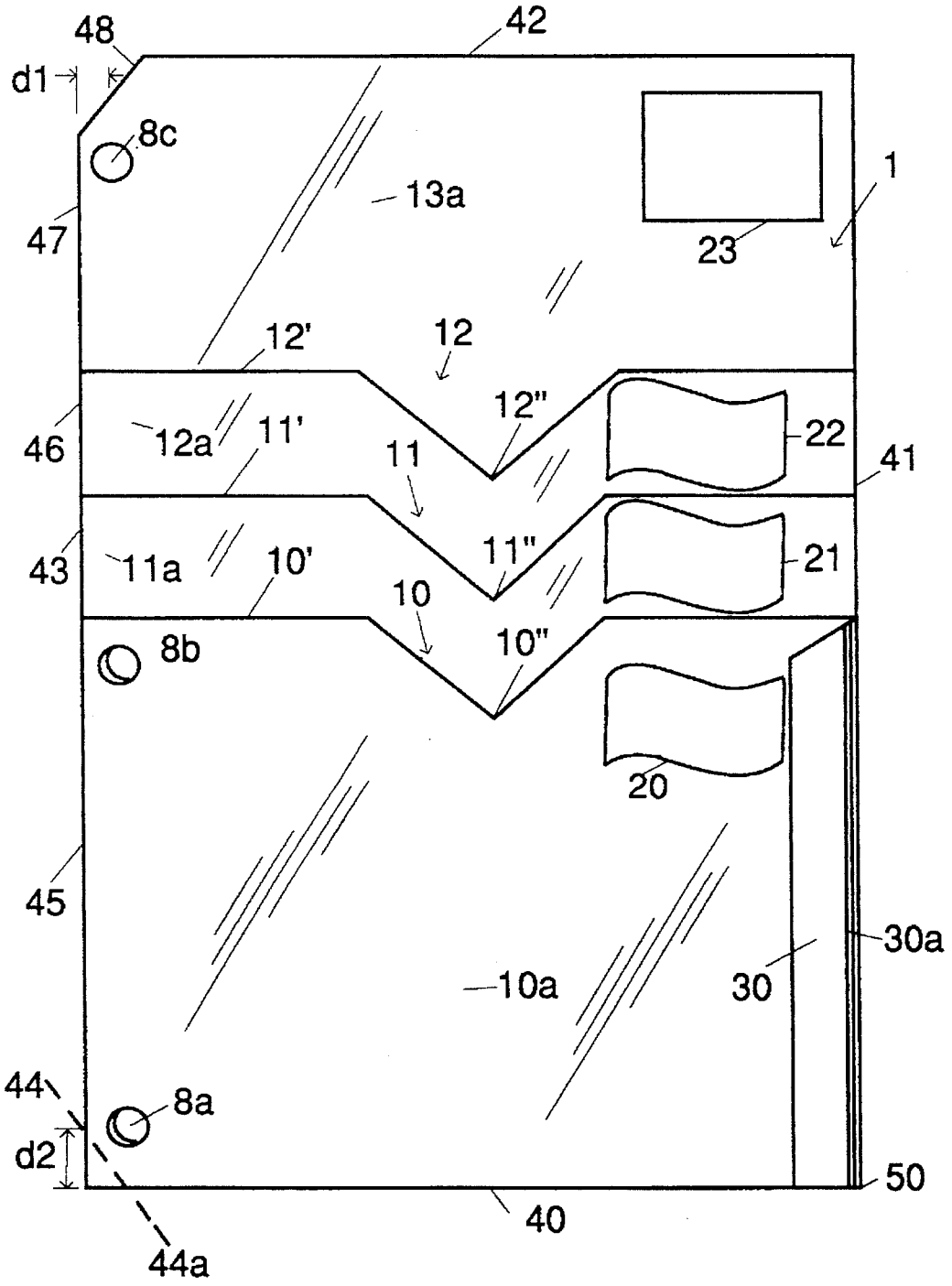
FIG. 1*a* shows the front view of the tri-level pocket of FIG. 1 having solely one tab used for closure of an outer edge of the tri-pocket structure.

FIG. 1 shows the preferred embodiment of the tri-pocket, 1, where each of the entry lips 10, 11, and 12 are stacked one above the next. The pockets are formed such that the first pocket is between a backing panel 13*a* and the first pocket panel 12*a*, the second pocket is between the second pocket panel 11*a* and the first pocket panel 12*a*, and the third pocket is between the third pocket panel 10*a* and the second pocket panel 11*a*. Each lip is formed from an edge 10', 11', 12' and has an optional finger depression 10", 11", 12". The lips may by cut at a slant but are shown here with horizontal cuts for each opening. Each pocket has a label 20, 21, and 22 and the pocket 1, has an overall category label area. Other labeling methods can be employed and still be in the scope of the invention such as die cutting the edges to permit the protrusion of one or more label tabs which would extend outside the "footprint" of the pocket suite(the traditional index tab technique). The pocket set is closed on both right and left sides by tabs 30 and 30'. Each enclosing tab can optionally be fitted with an expansion panel 30*a* and 30*a'* which can be formed by striking the sections and leaving them free of adhesive so as to permit expansion upon filling the pockets. Other ways may be employed such as die cutting a series of angled slits as is common practice in other pocket formations. The tab 30' is optional and when the pocket is fitted with the optional holes 8*a* and 8*b*, the enclosure can be provided by the rings of host ring binder. FIG. 1*a* shows the front view of the pocket described above formed with only one tab closure structure, 30, which tab forms the closure along a second of the closed edges, 41, of the multi-pocket array, leaving two open or free edges, 45, and the set of edges 10'/11'/12'.

Figure 2A:
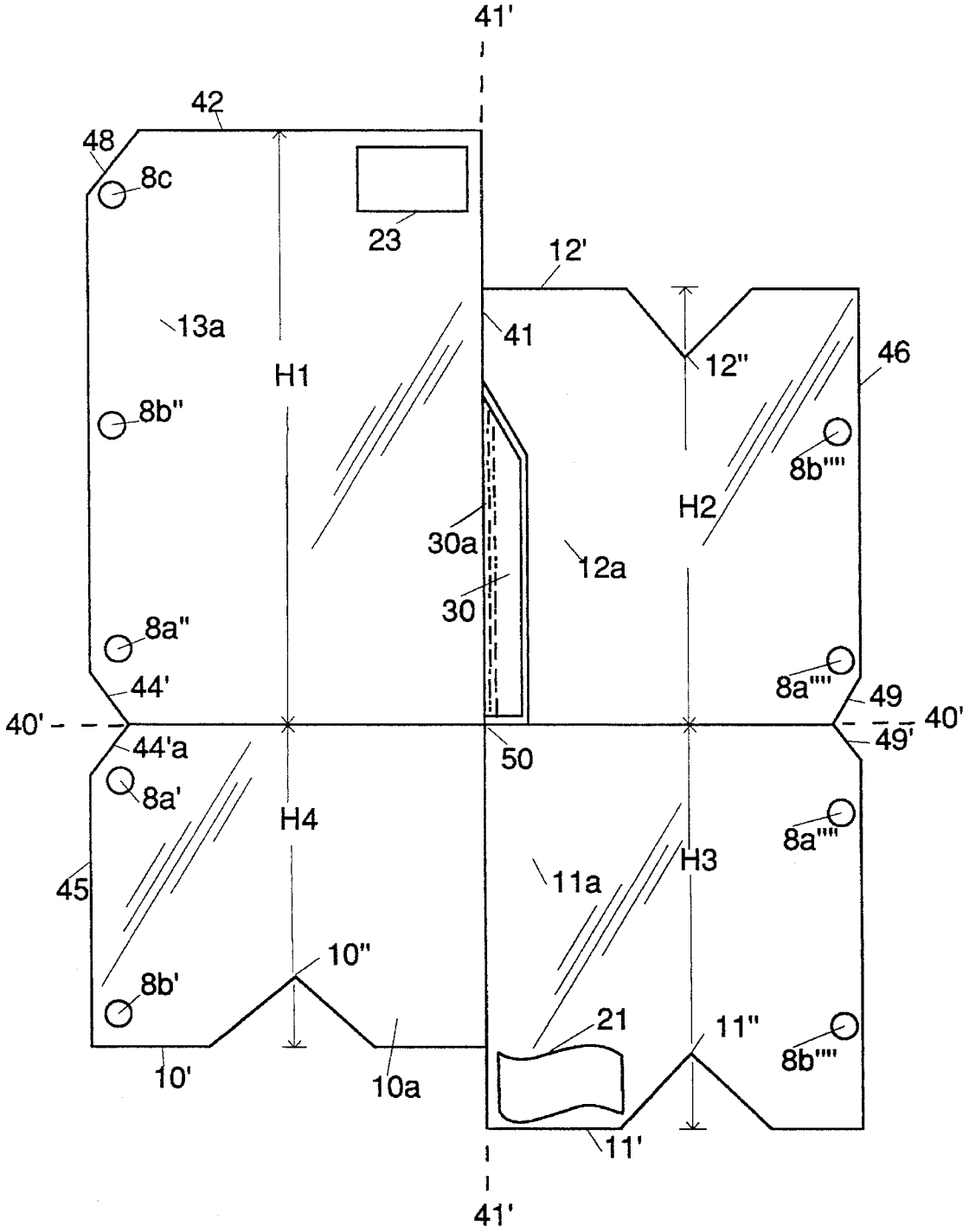
FIG. 2A shows the the front view of the cut pattern for FIG. 1*a* in which the pocket formation may be made by the operation of two folds and a single sealing operation on the closure tab.
Figure 2:
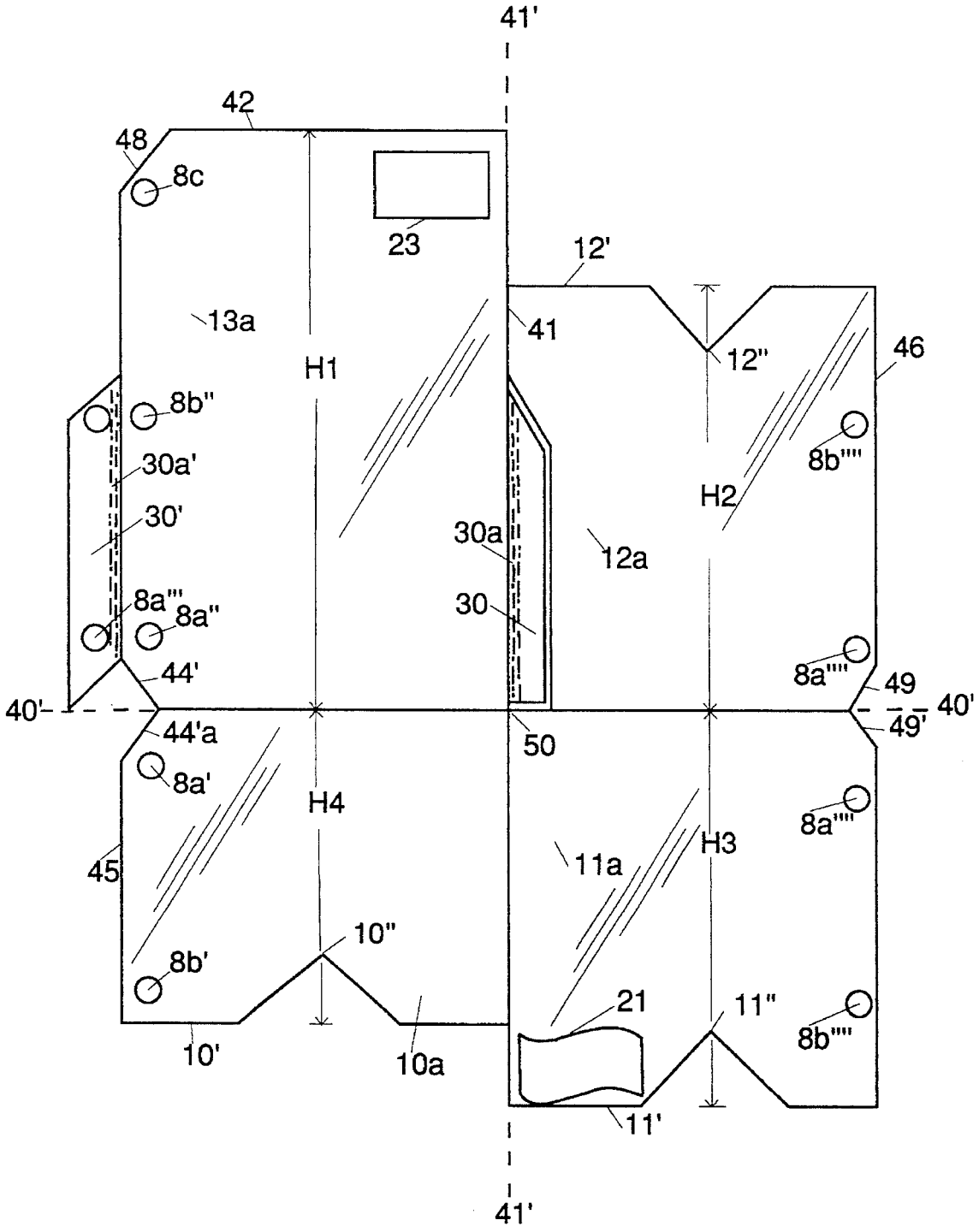
FIG. 2 shows the front view of the cut pattern which allows the formation of a tri-pocket according to the invention by two folds and a sealing operation.

Each of the edges 45, 43, 46, and 47 are brought together to make the pockets as shown in FIG. 2. Here the pattern is opened to disclose the preferred method of construction. The pocket lips are each at a respective distance from 40', which distances are heights H1, H2, H3, and H4. H1 is greater than H2 which is greater than H3, which is greater than H4. Made from a card stock, optionally in colored form where each panel can be a different color or a set of pockets each having a different color can be made. The first fold is about axis 41'. This brings over edge 46 and 43. The second fold is about axis 40' which brings up edge 45 and 43. The sealing step involves bonding tab 30 to the front of the face of section 10*a*. Optional tab 30' may also be bonded thereon. The tabs are on the opposing lateral edges of the backing panel and are die cut therein, where one tab extends outside the foot print of the edge on which it is cut and the other is cut from the first pocket panel 12*a*. Category level 23 is shown. Tabs may be cut to extend from an edge to further improve on the indexing. One or more of the lip edges 41, 10', 11', and 12' can be slash cut(i.e. cut at an angle) and still be within the scope of this invention. FIG. 2*a* shows the front view of the cut pattern for FIG. 1*a* in which the pocket formation may be made by the operation of two folds, a first fold along axis 41', and a second fold along axis 40', and a single sealing operation on the closure tab, 30, which is sealed onto the front face of panel 10*a*.

Figure 3:
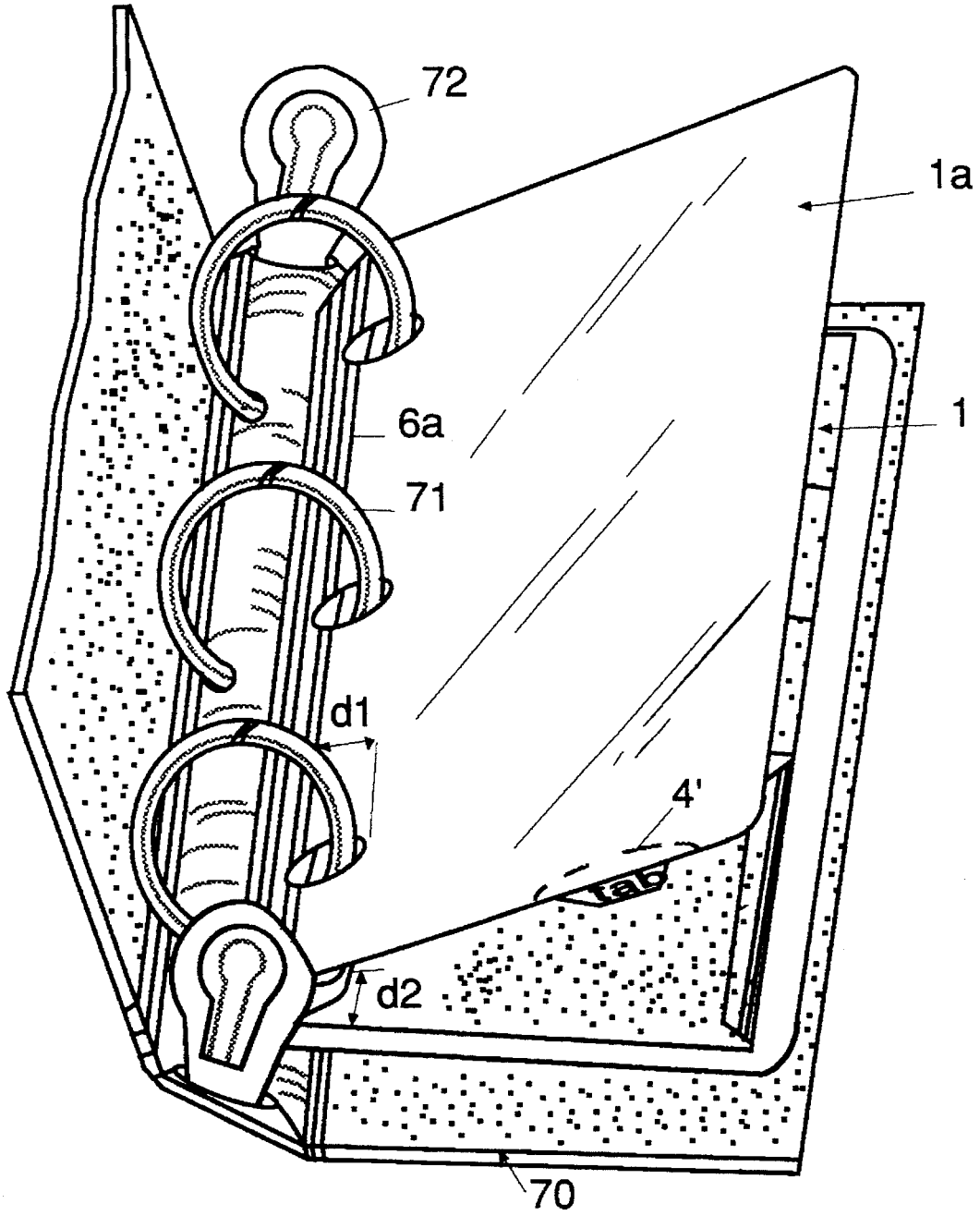
FIG. 3 shows a perspective view of the Tri-pocket according to the invention placed in a ring binder between the covers of an encasing pocket.

FIG. 3 shows a perspective view of the Tri-pocket, 1, according to the invention placed in a ring binder between the covers of an encasing pocket, 1*a*. The distance d1 is set to enable the "cocooning" of the tripocket within an encasing pocket and the distance d2 is set so as to allow the tri-pocket to fit within the foot print of the encasing pocket 1*a*, and still allow the tab 4', to "show past it".

The bonding step will depend on the material used. Special adhesive is needed for Tyvek for example. Cardstock can be glued. Instead of tabs 30 and 30', other methods can be employed. The edge can be stapled for example.

Optional angle cuts 48, and 44/44', and 49/49' allow for use of this pocket array in a ring binder and enable the pocket to miss the ring binder clips. In FIG. 3, the use of the tri-pocket within a cocoon, which is set within a ring binder is shown. The hole distances d1 and d2 are particularly important for the preferred application of "cocooning". In cocooning, the pocket will be placed within another enclosing pocket. The enclosing pocket will be retained in a standard ring binder of any ring dimension. Therefore, the offset distance d1 should be "narrow" allowing for retention of the pocket array as close to the ring binder as possible. Reinforcing the holes may be desirable to allow for the shortest realistic distance d1. Further d2 should be set to permit the bottom edge of the pocket 40 to reside on order of ½" from the bottom of the host ring binder. For this reason, 48 is slit to permit the top corner to turn freely past a host ring binders clips when present. The cocooning construction is fundamental to the application of this pocket configuration in which we are calling "Demand Paging" where one carries of moves around a set of leaves of paper which are related to "current transactions" and the objective for portability achieves the "10/90" rule where 10% of the "mission critical" information you need is available to you 90% of the time in the cocoon configuration you have at your finger tips at that moment.

Demand paging allows leaves to move through the cocoon, and in particular the tri-pocket array on an as needed basis, where as records on leaves "age" they can be moved to a respective archive for referential access.

The preferred construction would be in a card stock and would be of a suitable color to fit with the consumer application, maniallo being a popular one with most universal appeal.

Edges 10', 11', and 12' can be slant cut to give the pockets greater opening feel without loosing the holding capacity of the each pocket portion. The Pocket may be bonded from sections of plastic or die cut and folded over plastic which would eliminate the need for the extra tab sections which are adhesively overlapped. With plastic, various ways of sealing are possible where the molecules are excited and temporarily liquify allowing adhesion. Expansion sections can be included in either method to allow for increased storage capacity in the pocket area. The pressure of each pocket one on the next gives sufficient holding strength to materials encased to make the pocket a highly portable means for sorting and carrying temporary information. The subcategory feature lends itself to archival storage as well.

I claim:

1. A section of foldable material for forming a tri-pocket array, said section of material comprising at least an interconnected set of panels including a backing panel of predetermined height having perimeter features including adjoining first and second backing panel edges, a first pocket panel, a second pocket panel, and a third pocket panel, said interconnected set of pocket panels being attached off at least one of said first and said second of said adjoining first and second backing panel edges, each of said pocket panels having an entry lip edge of predetermined height, said pocket panels forming a first pocket, a second pocket, and a third pocket of a tri-pocket array, wherein a first pocket panel of said first, second, and third pocket panels is disposed along a first of said first and second adjoining backing panel edges, and a third pocket panel of said first, second, and third pocket panels is disposed along a second of said first and second adjoining backing panel edges, and where a second pocket panel of said first, second, and third pocket panels is disposed between said first pocket panel and said third pocket panel of said first second, and third pocket panels, and where each of said predetermined heights of said first, second, and third pocket panel entry lip edges is less than said predetermined height of said backing panel.

2. A tri-pocket array having an inner pocket, an outer pocket, and a middle pocket interposed between said inner pocket and said outer pocket, providing a first pocket, a second pocket, and a third pocket, said tri-pocket array comprising:

a first closure structure, and at least one inter-folded set of interconnected panels, said interconnected panels comprising a section of foldable material having a backing panel, a first pocket panel, a second pocket panel, and a third pocket panel, said backing panel having perimeter features including a front face, a back face, and adjoining first and second backing panel closure edges, each of said pocket panels having perimeter features including a front face, an entry lip edge and a plurality of pocket panel edges, said pocket panels for forming said first pocket, said second pocket, and said third pocket of said tri-pocket array, said closure structure for closing a common pocket panel edge of said plurality of pocket panel edges of each of said first, second, and third pocket panels, wherein said pocket panels are interconnected with said backing panel along at least one of said first and said second of said adjoining first and second backing panel closure edges, and said pocket panels are inter-folded, each one on top of the other, and on top of a common face of said backing panel with each of said entry lip edges of said first, second, and third pocket panels substantially co-planar on top of said common face of said backing panel, and wherein said first closure structure is closed with said outer pocket along one of said first and said second adjoining first and second backing panel closure edges, such that at least two of each of said plurality of pocket panel edges of each of said first, second, and third pocket panels is substantially closed and each of said entry lip edges of said first, second, and third pocket panels is substantially open, thereby forming a multi-level pocket array comprising a first pocket, a second pocket, and a third pocket.

3. The tri-pocket array of claim 2 where said first closure structure is a foldable tab substantially aligned along one of a first and a second of said adjoining first and second backing panel edges.

4. The foldable tab of claim 3 where said foldable tab further comprises an expansion section.

5. The tri-pocket array of claim 2 where said each of said pocket panels has a depression cut along said entry lip edge for allowing separation of one pocket panel from the next.

6. The tri-pocket array of claim 2 wherein at least one of said front faces of at least one of said pocket panels and said backing panel has a label section.

7. The tri-pocket array of claim 2 where said section of foldable material is tyvek spun olefin material.

8. The tri-pocket array of claim 2 where said section of foldable material is cardstock material.

9. The tri-pocket array of claim 2 where said section of foldable material is polypropelene material.

10. The tri-pocket array of claim 2 where said section of foldable material is vinyl material.

11. A tri-pocket array having an inner pocket, an outer pocket, and a middle pocket interposed between said inner pocket and said outer pocket, providing a first pocket, a second pocket, and a third pocket, in combination with a ringed binding structure, said tri-pocket array comprising:

a first closure structure, and at least one inter-folded set of interconnected panels, said interconnected panels comprising a section of folded material having a backing panel, a first pocket panel, a second pocket panel, and a third pocket panel, said backing panel having perimeter features including a front face, a back face, adjoining first and second backing panel closure edges, and opposing backing panel edges, each of said pocket panels having perimeter features including a front face, an entry lip edge and a plurality of pocket panel edges, said pocket panels for forming said first pocket, said second pocket, and said third pocket of said tri-pocket array, said closure structure for closing a common pocket panel edge of said plurality of pocket panels edges of each of said first, second, and third pocket panels, wherein said pocket panels are interconnected with said backing panel along at least one of said first and said second of said adjoining first and second backing panel closure edges, at least one of said opposing backing panel edges has a hole pattern comprising a plurality of holes of predetermined hole diameter positioned substantially along said at least one of said opposing backing panel edges, and said pocket panels are interfolded, each one on top of the other, and on top of a common face of said backing panel with each of said entry lip edges of said first, second, and third pocket panels substantially co-planar on top of said common face of said backing panel, and wherein said first closure structure is closed with said outer pocket along one of said first and said second adjoining first and second backing panel closure edges such that at least two of each of said plurality of pocket panel edges of each of said first, second, and third pocket panels is substantially closed and each of said entry lip edges of said first, second, and third pocket panels is substantially open, thereby forming a multi-level pocket array comprising a first pocket, a second pocket, and a third pocket; and a ringed binding structure comprises at least a section of predetermined length and predetermined diameter, wherein said predetermined diameter of said ringed binding structure is less than said predetermined diameter of said plurality of holes, for permitting said section of ringed binding structure to pass through said plurality of holes;

such that said section of ringed binding structure is engaged in said plurality of holes for retaining said tri-pocket array.

12. The tri-pocket array, ringed binder structure combination of claim 1 wherein at least one additional pocket panel edge of said plurality of pocket panel edges of said first, second, and third pocket panels is aligned substantially opposing one of said first and said second of said adjoining backing panel closure edges, and is aligned with one of a first and a second of said said opposing backing panel edges, said at least one additional pocket panel edge having a plurality of holes of substantially said predetermined diameter of said opposing backing panel edge plurality of holes, and wherein said plurality of holes on said at least one additional pocket panel edge is aligned substantially coincidentally with said plurality of holes on said opposing backing panel edge, and wherein said section of ringed binding structure is engaged in each plurality of holes of said opposing backing panel edge and said at least one additional pocket panel edge, such that at least one of said first, said second, and said third pockets of said tri-pocket array is expandably closed by said ringed binder structure.

13. A tri-pocket array comprising an interconnected set of panels, said interconnected set of panels comprising a backing panel of predetermined height having perimeter features including a front face, a back face, and two sets of opposing edges, a first set of edges and a second set of edges, a first edge of said first set of edges further comprising a foldable closure tab along said first edge of said first set of edges, said first edge being a closure tab edge, and a set of pocket panels including a first pocket panel, a second pocket panel, and a third pocket panel, wherein each of said pocket panels is disposed substantially adjacent at least one of said first, said second, and said third of said pocket panels, each of said pocket panels having an entry lip edge of a predetermined height forming an entry lip of a first, a second, and a third pocket, said predetermined height of said each entry lip edge being less than said predetermined height of said backing panel, and where said predetermined height of said first entry lip edge of said first pocket panel is less than said predetermined height of said entry lip edge of said second pocket panel, and where said predetermined height of said second pocket panel is less than said predetermined height of said entry lip of said third pocket panel, and wherein said set of pocket panels is interfolded one on top of the other, and on top of a common face of said backing panel to form a first inner pocket, a portion of a second middle pocket, and a third top pocket, said portion of said second middle pocket is interposed between said first inner pocket and said third top pocket, wherein said third top pocket has a visible face, and wherein said closure tab is folded over said closure tab edge and fixedly attached to said visible face of said top top pocket for forming said second pocket such that each of said first second, and third pockets has a substantially open entry lip and three sides, and where said said entry lip of said each of said first, second, and third of said pockets is disposed one below the next forming a racked array of pockets, and at least one of said three sides of each of said first, second, and third pockets is substantially an open side.

* * * * *